United States Patent [19]

Hubbard

[11] Patent Number: 5,021,916

[45] Date of Patent: Jun. 4, 1991

[54] THEFT DETERRING SECURITY SYSTEM FOR ATTACHMENT TO POWERED APPLIANCES

[75] Inventor: James H. Hubbard, Boulder, Colo.

[73] Assignee: Ultimate Security, Inc., Denver, Colo.

[21] Appl. No.: 318,581

[22] Filed: Mar. 2, 1989

[51] Int. Cl.[5] ..... E05B 49/00

[52] U.S. Cl. ..... 361/171; 361/189; 340/825.31

[58] Field of Search ..... 361/170, 171, 189; 340/825.3, 825.31; 70/279, DIG. 30, 279 R, 279 A

[56] References Cited

U.S. PATENT DOCUMENTS

| | | | |
|---|---|---|---|
| 3,319,128 | 5/1967 | Nilssen | 361/114 |
| 3,755,718 | 8/1973 | Nicholson | 361/171 |
| 4,051,548 | 9/1977 | Hamada | 361/171 |
| 4,103,289 | 7/1978 | Kolber | 340/825.32 |
| 4,290,286 | 9/1981 | Rae | 70/279 |
| 4,494,114 | 1/1985 | Kaish | 340/825.31 |
| 4,604,708 | 8/1986 | Lewis | 340/825.31 |
| 4,683,462 | 7/1987 | Takeda et al. | 340/825.32 |
| 4,720,700 | 1/1988 | Siebold et al. | 340/568 |
| 4,734,896 | 3/1988 | Soma et al. | 340/568 |
| 4,907,429 | 3/1990 | Davis et al. | 70/279 |

*Primary Examiner*—J. R. Scott
*Assistant Examiner*—Jeffrey A. Gaffin
*Attorney, Agent, or Firm*—Earl C. Hancock

[57] ABSTRACT

A security device intervenes in the primary power input connection to an existing appliance. The user must set numbered thumbwheels to a correct numerical sequence preset through those same thumbwheels by the appliance owner before the device will connect the primary power to the attached appliance. Once the correct code is dialed in via the thumbwheels, a relay latches so that power is continuously available to the appliance until the primary power is lost as by disconnection of the appliance power cord for more than a short period of time. Reentry of the unique code is then necessary to operate the appliance. Labels are permanently affixed to the appliance to forewarn that it is not operational unless the correct code is entered. The attachment module is encased in potting compound to prevent bypassing of the power controlling circuits. The appliance is thus useless and of little value to a thief since it requires obvious disfiguring of the appliance to remove the combination lock assembly and/or the labels.

15 Claims, 3 Drawing Sheets

THEFT DETERRING SECURITY SYSTEM FOR ATTACHMENT TO POWERED APPLIANCES

BACKGROUND OF THE INVENTION

1. Field of the Invention

The present invention relates to security systems and methods for discouraging thefts or burglaries of powered appliances. More particularly, the present invention relates to security systems that are operable only in response to enablement of a person having knowledge of a predetermined code but which will otherwise disable the appliance. This invention is especially useful for attachment to a post-manufacture powered appliance so that unauthorized use of that appliance requires substantial modification or injury to the appliance.

2. Description of the Prior Art

Thefts and burglaries of relatively portable, powered appliances such as radios, stereos, tape recorders, televisions and the like are a continuing problem since the thief can usually offer an immediately usable appliance to a purchaser of such stolen property. Even with etching of original owner identification on the appliance chassis and/or recordation of appliance serial numbers, recovery of the stolen goods is difficult once a purchaser has acquired the item and put it into use. As a result, interest has remained strong in developing security systems for such powered appliances to reduce the value of the appliance in the hands of anyone other than the owner or those in privy to the owner.

A system for rendering automobile radios unusable when stolen is shown in U.S. Pat. No. 4,734,896 by Soma et al wherein a code from a portable controller must match a stored code in the car radio or an alarm is sounded. A calculator protective device in U.S. Pat. No. 4,103,289 by Kolber responds to failure to enter an initial sequence of characters by disabling the calculator as by continually clearing the registers. It also suggests that it is advisable to place some form of label on the protected device to warn the prospective thief that the calculator is so protected.

A system for responding to failure to enter the correct code by muting an audio amplifier circuit and including a timing circuit operable between retries is shown in U.S. Pat. No. 4,683,462 by Takeda et al. Siebold et al U.S. Pat. No. 4,720,700 shows digital code comparing systems for car radios wherein either the radio must remain in its mount within the car or the code must match a stored code word in a digital memory. Siebold et al also suggest attaching a warning label that the device becomes inoperative if stolen.

Several approaches have pursued adaptation of the microprocessor that already exists in some contemporary electronic appliances to prevent its operation by anyone not having a correct entry code. Typically such systems require entry of a unique digital code which is then compared against a digital code stored in some form of memory associated with the microprocessor. Once a favorable comparison has occurred, a circuit or relay is latched so that primary power remains coupled to the appliance even though the user turns it off and on many times. However, if the primary power is lost as by unplugging the appliance, the system requires reentry and another favorable code word compare before power is again made available to the appliance. Examples of configurations of systems which adapt the existing microprocessor for an appliance to provide power connection controlled security are described in U.S. Pat. No. 4,494,114 by Kaish and U.S. Pat. No. 4,604,708 by Lewis.

Adaptation of appliances having microprocessors incorporated therein is acceptable if the system is designed so as to include such features when the appliance is manufactured. However, once the appliance is built, adaptation of the microprocessor as a security device for that appliance is difficult and prohibitively expensive to the average purchaser. Furthermore, changes to the security code word typically require modifications to the program and/or electronic storage media associated with the microprocessor.

DISCLOSURE OF THE INVENTION

The present invention is concerned with methods and apparatus that are particularly useful for discouraging unauthorized use or theft of an appliance which is dependent upon power from a primary power source to operate satisfactorily. The appliance is of the type manufactured to receive electrical power suitable for operating the appliance from a power source which can take the form of a power cord or electrical leads attachable to the primary power source such as AC outlets, batteries or the like. The invention employs an electrical switch in conjunction with a mechanical combination lock operable in response to setting of a predetermined combination of symbols for electrically closing that switch.

An electrical latch responds to the switch closing so as to couple the electrical power source to the appliance. Further, this electrical latch responds to loss of the electrical power from the source by disconnecting the appliance from the power source. Preferably the mechanical combination lock includes a plurality of devices manually movable to display a plurality of combinations of visible indicia.

The visible indicia (such as numbers) and the mechanical combination lock mechanism includes elements alignable when the predetermined code is displayed for permitting movement of a manually movable actuator for operating the switch. The lock mechanism can include an arrangement operable in response to display of the user established predetermined code and movement of a manual lever or button to permit entry of a new or different unique code.

The electrical latch can incorporate a timer for delaying the disconnecting of the appliance for a predetermined period of time. This is intended to maintain the connection of the appliance to the source if the electrical power returns before passage of the predetermined time period. A preferred arrangement for maintaining power to the appliance is by a relay in the electrical latch circuit. By connecting the relay with its normally open contacts operable to close in response to actuation of the switch, these contacts through appropriate connections can retain operating power across the relay thereby latching it until the power is no longer available from the source.

The mechanical combination lock mechanism as described below has a dual release configuration and a plurality of display elements. Each display element has visually observable indicia thereon and is mounted for manual movement for exhibiting various indicia combinations. Each of the release structures is operatively enabled in response to positioning of the display elements so as to exhibit a predetermined indicia combination. The enabling of one of the release mechanisms causes closure of the actuator for the switch while enabling of the other release structure allows the user to reposition the display elements for establishing a new predetermined indicia combination.

Once the combination lock structure has closed the switch, the latch circuit responds by establishing a connection between the electrical energy source and the appliance as long as power remains available from the power source. Conversely, the latch circuit will disconnect the source from the appliance when power is no longer available from that source.

The latch circuit disconnecting operation is obtainable by use of a timer circuit operative for maintaining the connection of the power source to the appliance for a predetermined period of time following loss of electrical energy from the source. The latch circuit disconnects the source so as to again isolate it from the appliance only if power is not reestablished from the source during the predetermined timeout period.

A relay in the latch circuit arranged with its contacts holding the connection of source power to the relay itself keeps the circuit latched except when power is lost. Where the source produces AC power at its output, the latch circuit can include a rectifier to convert the AC into DC power. This allows the timer circuit to function with a DC electrical network having a time constant corresponding to the predetermined time period. This further allows use of a DC relay with its actuator coil connected to receive the DC power from the converter along with capacitor and resistor elements coupled in parallel with that relay coil to form the electrical network.

The module for securing the appliance in accordance with this invention is well suited for encasing in potting material to deter anyone from tinkering with the circuit connections so as to bypass the power intervention operation. This is especially valuable in conjunction with a secure attachment of the module to the frame or other major component of the protected appliance since it then requires substantial disfigurement to the appliance in order to defeat the power application control purpose of the module.

The present invention is particularly advantageous in that it provides a relatively low cost security device which is attachable to existing appliances without serious complexity or skill requirements. Furthermore attachment of the security module does not demand modification to the inner workings of the appliance beyond the primary power source connections.

Still further, this invention does not require any variations in the existing manufacturing processes for the appliances involved. It avoids the cost of microprocessor controlled systems as well as the difficulty of entering new and different code combinations into such microprocessors. It is remarkably convenient for the average appliance owner as it is relatively easy to change the security code to allow someone to energize the appliance for temporary uses such as loans to friends, repair operations, and so forth, with this same ease of security code change permitting reentry of the original or a new code.

Those having normal skill in the art will recognize the foregoing and other objects, features, advantages and applications of the present invention from the following more detailed description of the preferred embodiments as illustrated in the accompanying drawings.

DETAILED DESCRIPTION OF THE PREFERRED EMBODIMENT

Figure 1:
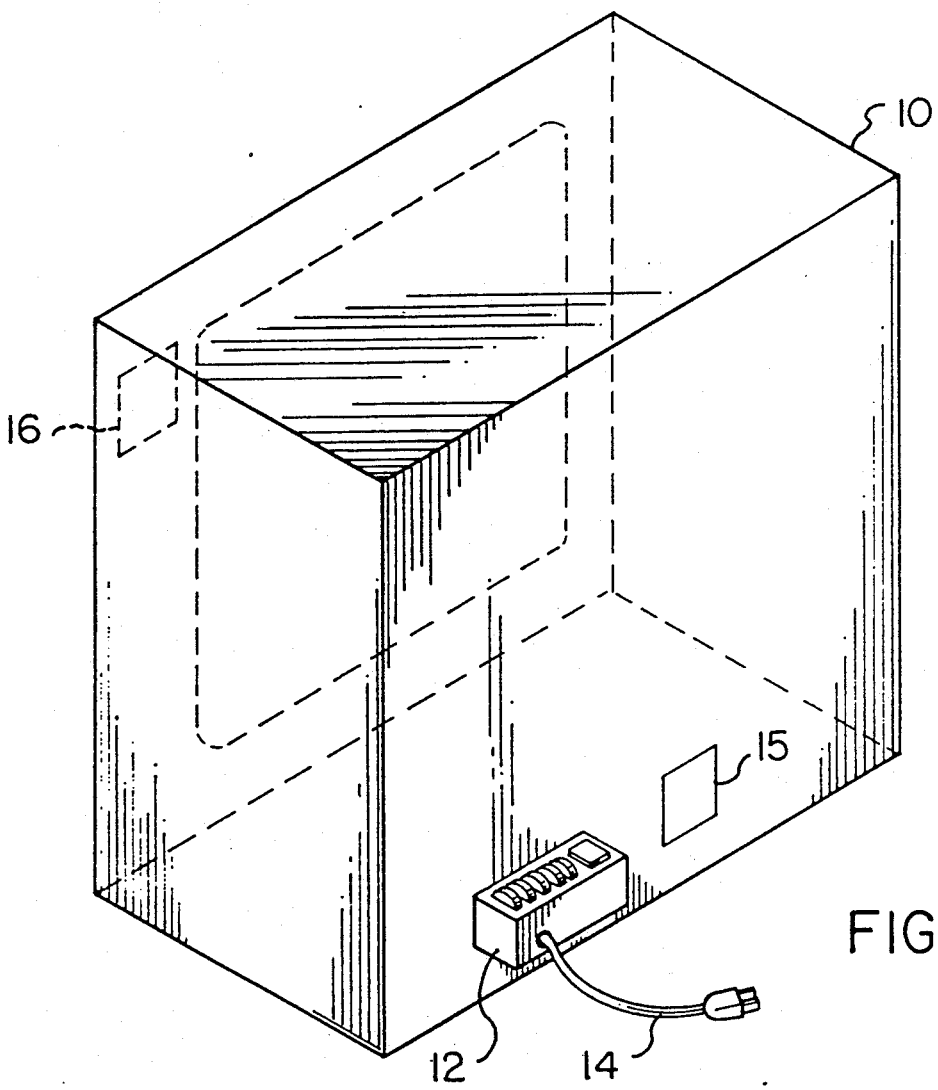
FIG. 1 is an overall view of a television appliance illustrating a power controlling security attachment in accordance with this invention.

The present invention is a security system attachable to an existing powered home appliance along the lines of the television 10 of FIG. 1. The system is incorporated into a module 12 to intervene between the primary power source not shown in FIG. 1. A wall outlet for receiving the plug of line cord 14 would provide the primary power source for television 10 in FIG. 1, although the present invention is equally well suited for intervening in the power line between the appliance and a battery pack or any other power source arrangement.

The present invention is not intended to prevent movement of appliance 10 but is rather for the purpose of discouraging theft by rendering appliance 10 inoperative to anyone without the knowledge of a unique security code established by the owner. Disabling of appliance 10 is accomplished by module 12 operating as an absolute bar to coupling of primary power from input line 14 to appliance 10 until the correct code is entered into module 12. Thereafter, primary power will remain connected to appliance 10 so that anyone can turn it on and off until primary power is again disconnected as by pulling the plug on cord 14 or by simply loss of power from the primary source. After either event, reentry of the correct code word with primary power present will again enable normal on/off operation of appliance 10.

Permanent labels are prominently as well as permanently affixed to appliance 10 such as by labels 15 and 16 secured to the respective rear and front panels of television 10. Labels 15 and 16 will state that television 10 is protected by a system in accordance with the present invention so that it is rendered inoperative without entry of a unique code word. Contemporary adhesives are available to affix labels 15 and 16 to the appliance 10 so that it is necessary to deface the appliance panels in order to remove the labels. Labels 15 and 16 can also include a place to imprint personalized security information such as social security numbers.

Module 12 is preferably encased in a conventional potting compound in a manner that does not interfere with the operation of either the combination lock mechanism for assembly 12 or the switch internal to the module which the lock mechanism actuates as is described later herein. Encasing of the components into a substantially solid unit with only the electrical connections 18 for appliance 10 and power cord 14 accessible externally along with the manually operable elements of the combination lock mechanism prevents tinkering with the internal components so as to bypass the power connection control function of module 12. Suitable epoxy based potting compounds are readily available commercially for encapsulating module 12.

Module 12 is permanently attached to the chassis of appliance 10 as by rivets, one-way screws, adhesive bonding, welding, or the like. This will present a serious impediment to the thief who contemplates bypassing module 12 so as to reconnect the primary power leads internally to appliance 10.

Figure 2:
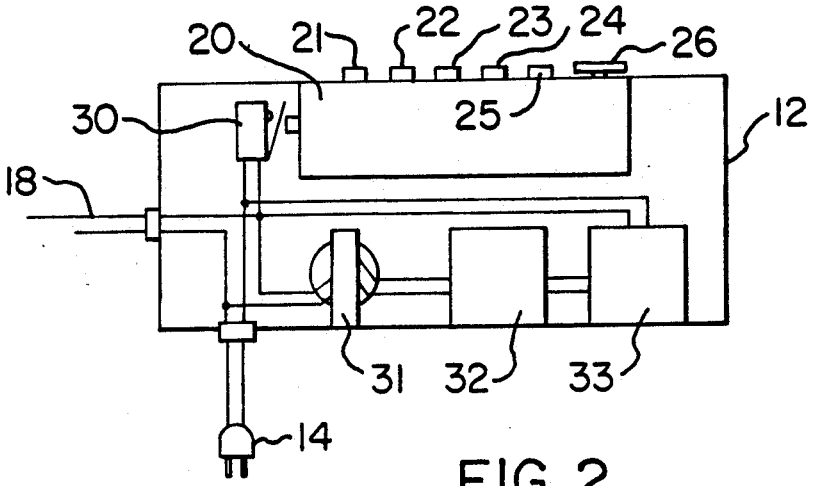
FIG. 2 is a side view of the FIG. 1 attachment.

The object of module 12 is to act as an intervening device between primary power cord 14 and the power connections internally to appliance 10 via output power leads 18. FIG. 2 is a view of the main components included in the exemplary configuration of a module 12 to produce this power connection control. These include a thumbwheel assembly 20 which is here illustrated with five thumbwheels 21 through 25 and an actuator button 26. These thumbwheels 21–25 each have tens digits visibly arrayed in sequence around their segmented peripheral surface.

As is described in greater detail below, the thumbwheel encoder/decoder assembly 20 includes a mechanism which responds to proper alignment of five consecutive digits and manual movement of button 26 to the left in FIG. 2 by closing microswitch 30. Transformer 31 is continually coupled to one side of the primary power input 14 and has its output connected for continually energizing rectifier assembly 32 as well as relay 33. Closure of switch 30 by the decoder action of assembly 20 causes relay 33 to latch and hold primary power 14 across transformer 31 and thus also across output leads 18.

Figure 3:
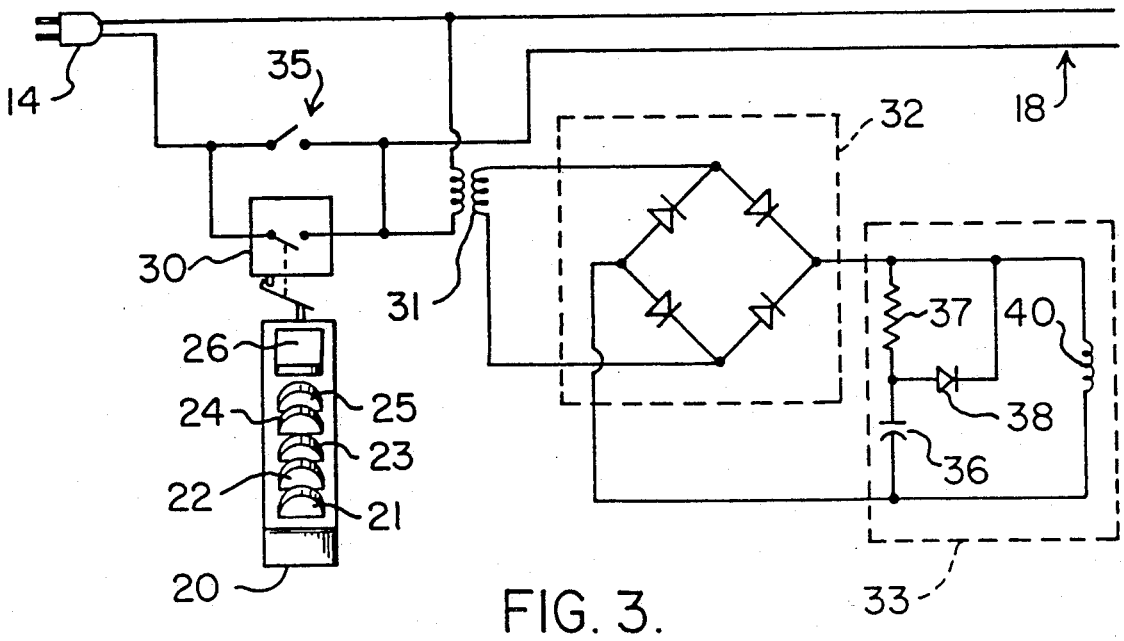
FIG. 3 is a schematic diagram of one form of operating circuit for implementing the present invention.

As is apparent from FIG. 3, when power cord 14 of appliance 10 is initially plugged in, the normally open contact 35 of relay 33 prevents application of power to output leads 18. Normally open switch 30 must close to initiate the power-on sequence. Manually operated pushbutton 26 is only movable to close the contacts of switch 30 if the preset unique code is dialed into the thumbwheels 21–25. Any other sequence of numbers inhibits movement of the push button 26.

In operation of the embodiment shown, plug 14 is plugged into an appropriate AC power outlet. The unique code is dialed into thumbwheels 21–25 and push button 26 is slid so as to depress the actuator of switch 30. Once switch 30 closes, primary power is applied to the primary windings of transformer 31. The secondary of transformer 31 applies power to the full wave rectifier 32. The DC output of rectifier 32 is applied to capacitor 36 through current limiting resistor 37 paralleled by diode 38 into pick coil 40 for relay 33. This closes the normally open contact 35.

Relay contact 35 applies power to the primary of transformer 31 and keeps the relay 33 latched in the picked position. Power is likewise maintained to the appliance leads 18. Upon release of pushbutton 26, the contact for switch 30 opens. The operator then shifts the thumbwheels 21–25 so that the unique code is no longer visible but power will remain on output leads 18 until either cord 14 is unplugged or the AC power is lost at the wall outlet into which cord 14 is plugged.

Capacitor 36 is charged through current limiting resistor 37. It holds relay 33 in the pick position through short term power outages and prevents nuisance power interruptions. If power is removed from line cord 14 as would happen if someone was attempting to steal appliance 10, relay 33 will drop after the RC time constant of capacitor 36 and the resistance of relay coil 40 along with the negligible parallel resistance of resistor 37 and diode 38. Normally open relay contact 35 will again open rendering appliance 10 inoperative until the user set unique code is dialled into the combination lock via thumbwheels 21–25 and the system is again latched on line.

Note that it is possible to arrange the RC time constants with adequate delay to accommodate a brief disconnection but of sufficient duration to allow relocation of the appliance without having to reenter the code. This could permit movement of a television from one outlet to another, for instance. If the RC time constant is not surpassed, plugging the primary power cord 14 into a new AC outlet would begin recharging capacitor 36 before its charge was reduced below the level that would drop relay 33.

This security system removes the resale value of appliance 10 from the potential thief and therefore significantly reduces the risk to the owner of someone stealing the property. The entire device is designed in such a manner that it is necessary to destroy the case to gain access to the electric components. This security device is attached to the electric appliance such as a television, a VCR, a stereo, a microwave oven, or other household appliance in such a manner that a trained technician is required to remove it. The labels 15 and 16 attached to the appliance 10 state that this security device is installed and that the appliance becomes inoperative if the line cord is unplugged. The labels are affixed with an adhesive that will damage the appearance of appliance 10 if removal is attempted thereby further reducing the resale value of a stolen appliance.

Figure 4:
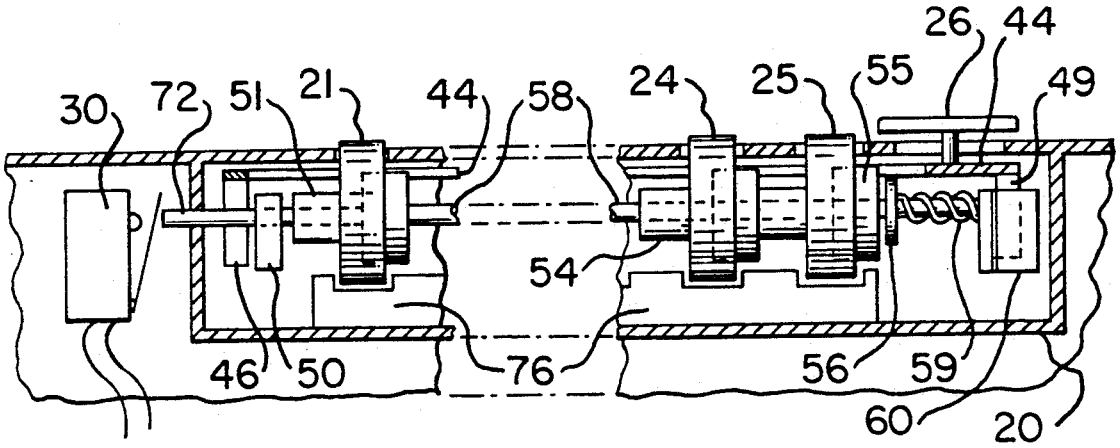
FIG. 4 is a partially sectioned side view of the code entry and changing mechanism.
Figure 6:
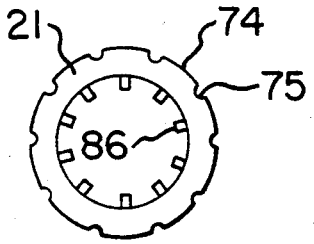
FIG. 6 is a side view of a number wheel for the code mechanism.
Figure 7:
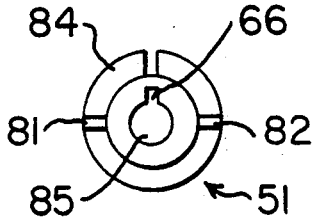
FIG. 7 is a side view of an inner hub which cooperates with a FIG. 6 type wheel.
Figure 5B:
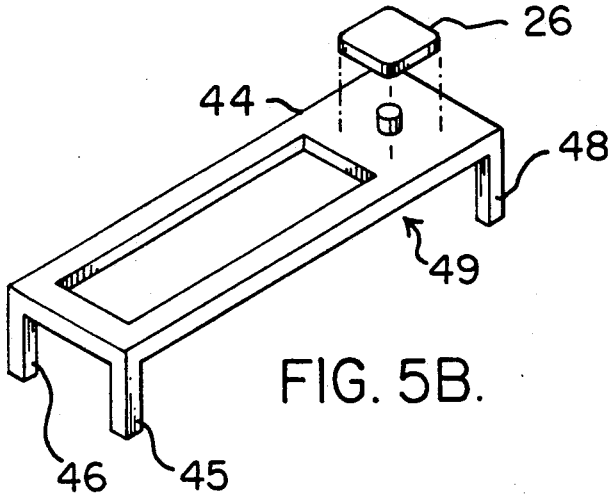
FIG. 5B is an isometric view of the slider associated with the FIGS. 4 and 5A structure.
Figure 5A:
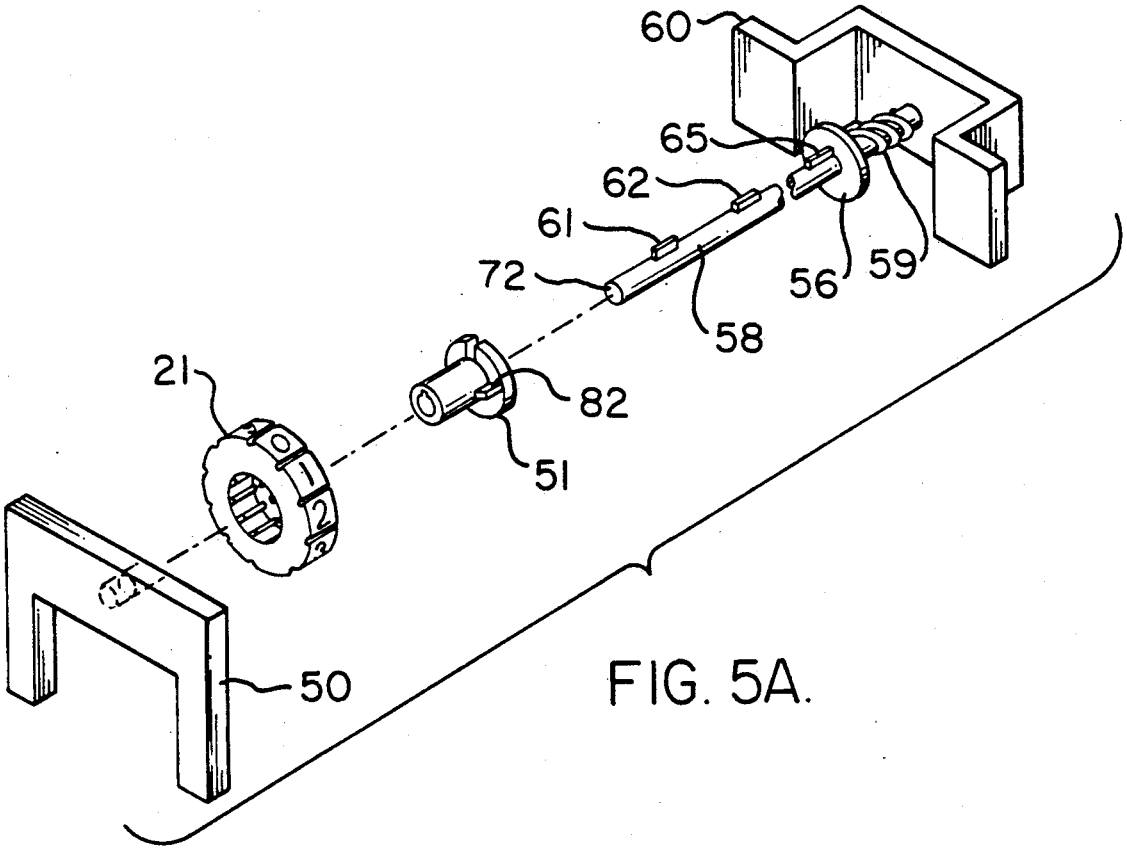
FIG. 5A is an isometric exploded view of selected code wheel related components from the FIG. 4 mechanism.

The components of combination lock assembly 20 are shown in partially sectioned view in FIG. 4, and in exploded isometric view in FIGS. 5A and 5B, while a typical thumbwheel and inner hub are shown in FIGS. 6 and 7, respectively. Pushbutton 26 is rigidly attached to slider 44 which has two downwardly extending legs 45 and 46 on one end and two other downwardly extending legs 48 and 49 at the opposite end. Legs 45 and 46 press against the outer face of left block 50 as seen in FIG. 4. When pushbutton 26 and thus slider 44 is moved to the right, left block 50 pushes against the left end of inner hub 51 the right end of which presses against the left end of hub 52. Thus each of inner hubs 51 through 55 are pressed to the right. Ultimately this pressure is applied to washer 56 which is slidably mounted on inner shaft 58 so that it compresses spring 59 against right end block 60.

By setting the wheels 21–25 so that the interior slots of their associated inner hubs 51–55 are in alignment with shoulders 61–65 on inner shaft 58, it is possible to move slider 44 to the right in FIG. 4. As a result of this pressure and shifting of inner hubs 51–55 to the right, outer wheels 21–25 are disengaged from their associated inner hubs 51–55 allowing rotation of the outer wheels 21–25 to a user selected five digit code number sequence. Upon release of slider 44, the outer wheels 21–25 again engage their inner hubs 51–55 thereby setting the new code. It is thereafter necessary to reset wheels 21–25 to this number to cause shoulders 61–65 to realign with the inner slots like 66 for hubs 51–55 to allow switch operation as described below. The disengagement of hubs 51–55 from their corresponding wheels 21–25 is perhaps best seen in FIGS. 6 and 7. Typically, thumbwheel 21 has ten peripheral surfaces such as 74 on which numbers, letters or symbols are printed and which are separated by a notch like 75. Notches 75 cooperate with a spring member of wheel retainer 76 (see FIG. 4) to retain the wheels in place. Note that retainer 76 also cooperates with the openings in the upper surface of the container wall for assembly 12 to keep the wheels 21–25 from moving laterally with the hubs 51–55 or shaft 58.

Hub 51 has two shoulders 81 and 82 extending from collar end 84 as seen in FIGS. 5A and 7. It also has a central bore 85 with slot 66 running axially through its interior. Shoulders 81 and 82 fit between any pair of stubs such as 86 in FIG. 6 which extend radially inwardly from the inner surface of wheel 21. This allows the hub 51 to disengage wheel 21 when it is moved to the right in FIG. 4 thus letting the user pick the code number by rotating wheel 21 while disengaged hub 51 remains still. Upon re-engagement of hub 51 into wheel 21, the two will turn as a unit and it is necessary to have the correct digit visible through the slots in the upper wall of assembly 12 for the corresponding lug 61 to align with inner slot 66 to permit operation of the switch 30.

Still as seen in FIG. 4, movement of slider 44 to the left causes legs 48 and 49 to press against right side block 60. If the correct numbers are set on wheels 21–25, shoulders 61–65 align with the inner slots of hubs 51–55 and slider 44 and block 60 can move to the left. That is, shaft 58 and right block 60 are only allowed to move if all keyways of inner hubs 51–55 are in line with the lugs 61–65 on shaft 58. If shaft 58 is allowed to move to the left, end 72 of shaft 58 operates the actuator of microswitch 30 thereby closing switch 30 and applying power to transformer 31.

Slider 44 is movable to the right in FIG. 4 to reset the code or to the left to close switch 30 only if the outer wheels 21–25 are aligned in such a manner to line up all the inner hub 51–55 keyways (e.g.: 66) with the lugs 61–65 on shaft 58. This requires setting wheels 21–25 with the correct unique code. If the keyway of any one of hubs 51–55 is out of alignment with its corresponding lug 61–65, the system is locked and inoperative.

The use of five digits for the code entry is considered adequate to discourage deciphering of the entry code by manual replication, i.e.: by simply trying all possible combinations of numbers. Of course more or less numbered code wheels are acceptable for the present invention. The degree of difficulty in laboriously determining the numbers for the unique code increases by a factor of ten for each numbered code wheel included, and vice versa. While use of a single code wheel would appear ineffective to deter a burglar or thief, it might prove helpful under some circumstances such as in controlling the use of the protected appliances by young children.

Note that the system described is particularly advantageous in the ease with which it is possible to reset controlling code combinations. For instance, if the user has to deliver the appliance to a shop for repairs or to allow a repairman to operate the appliance, the user can merely reset the code to all zeros and inform the repairman to use that code to operate the device. Then, after completion of the repairs, it is a simple matter to change the code back to another set of numbers.

Yet another advantage from this invention is that it is applicable to a wide variety of existing appliances so that they all have the same unique code entered. The same module is attachable to electronic equipment, power tools and household appliances of all kinds. This minimizes the number of codes that the user must remember, a hazard that is encountered if a plurality of appliances have different codes buried in their microprocessor memories at manufacture.

While the exemplary preferred embodiments of the present invention are described herein with particularity, those having normal skill in the art will recognize various changes, modifications, additions and applications other than those specifically mentioned herein without departing from the spirit of this invention.

What is claimed is:

1. Apparatus for discouraging unauthorized use or theft of an appliance which is dependent upon power from a primary power source to operate satisfactorily comprising a source of electrical power suitable for operating the appliance, an electrical switch means, mechanical combination lock means operable in response to setting of a predetermined combination of symbols for enabling manual closure of said switch and for blocking manual closure of said switch for any other combination of symbols, and electrical latch means responsive to closing of said switch for coupling said electrical power source to the appliance, said electrical latch means further responding to loss of the electrical power from said source for disconnecting the appliance from said source;

and said mechanical combination lock means includes elements alignable when said predetermined code is displayed for permitting movement of a manually movable actuator for operating said switch.

2. Apparatus in accordance with claim 1 wherein said mechanical combination lock means includes a plurality of devices manually movable to display a plurality of combinations of visible indicia.

3. Apparatus in accordance with claim 2 wherein said visible indicia are numbers.

4. Apparatus in accordance with claim 2 which includes means encasing said switch means, said mechanical combination lock means and said latch means as a solid unit with said symbol means manually accessible externally to said unit and including means for establishing external connections with said source and the appliance.

5. Apparatus in accordance with claim 3 which includes means operable in response to display of said predetermined code and movement of said manually movable means for permitting entry of a different code.

6. Apparatus in accordance with claim 1 wherein said electrical latch means includes means for delaying the disconnecting of the appliance for a predetermined period of time and for maintaining connection of the appliance to said source if the electrical power from said source returns before passage of said predetermined period of time.

7. Apparatus in accordance with claim 1 wherein said electrical latch means includes a relay with normally open contacts operable in response to actuation of said switch for closing said contacts and retaining operating power, across said relay until the power is no longer available from said source.

8. Apparatus for discouraging unauthorized use or theft of an appliance which requires a primary power input for operation comprising a source of electrical energy for producing the primary power required by the appliance, an electrical switch having an actuator for closure thereof, mechanical combination lock means including first and second release means and a plurality of display elements with each said display element having visually observable indicia thereon and with each said display element mounted for manual movement for exhibiting combinations of said indicia, said release means each becoming operatively enabled in response to positioning of said display elements so as to exhibit a predetermined combination of said indicia, enabling of said first release means causing closure of said switch by said actuator while enabling of said second release means allowing repositioning of said display elements for establishing a new said predetermined indicia combination, and latch circuit means responsive to closure of said switch means for establishing a connection between said electrical energy source and the appliance as long as power is available from said source and including means for disconnecting said source from the appliance when power is no longer available from said source.

9. Apparatus in accordance with claim 8 wherein said latch circuit disconnecting means includes a timer circuit operative for maintaining the connection of said source to the appliance for a predetermined period of time following loss of electrical energy from said source and for disconnecting said source from the appliance only if power is not reestablished from said source during said predetermined period of time.

10. Apparatus in accordance with claim 9 wherein said latch circuit means includes a relay with contacts of said relay holding the connection of said source to said relay except when power is lost.

11. Apparatus in accordance with claim 10 wherein said source produces AC power at its output and wherein said latch circuit means further includes means for converting the AC power into DC power, said timer circuit including an electrical network having a time constant corresponding to said predetermined period of time.

12. Apparatus in accordance with claim 11 wherein said relay has an actuator coil connected to receive said DC power from said converter and said electrical network includes capacitor and resistor elements coupled in parallel with said relay coil.

13. Apparatus in accordance with claim 8 which includes means encasing said switch, said mechanical combination lock means and said latch circuit means in potting material as a solid unit with said indicia display elements and means for operating said release means manually accessible externally to said unit, and means for establishing external connections from said unit to said source and the appliance.

14. A method for discouraging unauthorized use or theft of an appliance which is dependent upon electrical power introduced to the appliance at an input connection from a primary power source to operate satisfactorily comprising the steps of intervening between the appliance and the power source with a mechanical combination lock mechanism which has a plurality of manually settable indicia displaying elements, closing a switch to connect the power source to the appliance in response to the presence of a predetermined combination of indicia on the displaying elements, disconnecting the power source from the appliance whenever electrical power is no longer present from the power source, and delaying said disconnecting step for a predetermined time period to maintain power for the appliance despite power interruptions for periods less than the predetermined time period, whereby loss of power from the source for a length of time greater than said predetermined time period requires reentry of the predetermined combination of indicia before the appliance is again operable.

15. The method in accordance with claim 14 which includes the step of encapsulating the indicia displaying elements and the power connecting elements into a solid unit having the display elements manually accessible externally to the unit and with external power connections to the source and the appliance from the unit, and securing said unit to the appliance so that removal of the unit from the appliance results in disfigurement of the appliance.

* * * * *